US005957341A

United States Patent [19]

Schiestel

[11] Patent Number: 5,957,341

[45] Date of Patent: Sep. 28, 1999

[54] SPRAY CAN

[75] Inventor: Rolf Schiestel, Markdorf, Germany

[73] Assignee: Peter Kwasny GmbH, Gundelsheim, Germany

[21] Appl. No.: 08/819,233

[22] Filed: Mar. 17, 1997

[30] Foreign Application Priority Data

Sep. 6, 1996 [DE] Germany ..... 196 36 221

[51] Int. Cl.[6] ..... B65D 83/14

[52] U.S. Cl. ..... 222/394; 222/402.1

[58] Field of Search ..... 222/394, 402.1; 239/337

[56] References Cited

U.S. PATENT DOCUMENTS

| | | | |
|---|---|---|---|
| 3,819,119 | 6/1974 | Coffey et al. | 239/337 |
| 3,915,390 | 10/1975 | Green | 222/394 |
| 4,001,391 | 1/1977 | Feinstone et al. | 222/394 |
| 4,278,188 | 7/1981 | Stephenson et al. . | |
| 4,401,271 | 8/1983 | Hansen . | |
| 5,143,288 | 9/1992 | Kohler | 239/337 |
| 5,314,097 | 5/1994 | Smrt et al. | 222/394 |

FOREIGN PATENT DOCUMENTS

| | | |
|---|---|---|
| 2 401 074 | 3/1979 | France . |
| 2 737 084 | 1/1997 | France . |
| 2 009 922 | 12/1970 | Germany . |
| 26 49 997 | 5/1978 | Germany . |
| 30 29 704 | 3/1982 | Germany . |
| 28 19 635 | 9/1983 | Germany . |
| 38 08 405 | 8/1989 | Germany . |
| 195 11 771 | 12/1995 | Germany . |
| 692 03 459 | 4/1996 | Germany . |
| 296 17 635 U | 1/1997 | Germany . |
| WO 93/23313 | 11/1995 | WIPO . |

*Primary Examiner*—Philippe Derakshani
*Attorney, Agent, or Firm*—Kenyon & Kenyon

[57] ABSTRACT

A spray can, particularly for paints and paint preparation materials, is pressurized with a propellant, particularly propellant gas, as a result of which the paint material can be sprayed when a valve is opened. In order to substantially increase the paint output amount per unit time so that a greater layer thickness is achieved in the same working time, the propellant provided in the spray generates a pressure of 4.5 to 6 bar, the output amount of the paint material is 15 g to 35 g per 10 seconds for uninterrupted flow, and that the paint is output in the form of broad-stream atomization.

3 Claims, No Drawings

SPRAY CAN

FIELD OF THE INVENTION

The present invention relates to a spray can, particularly for paints and paint preparation materials (both referred to hereinafter as "paint material"), where the spray can is pressurized with propellant, particularly propellant gas, as a result of which the paint material can be sprayed when a valve is opened.

BACKGROUND OF THE INVENTION

Such spray cans have been known for many years for different areas of application and for a variety of materials to be sprayed. They are sold by the millions, particularly in the household and do-it-yourself sector. Spray cans for paints and paint preparation materials are primarily used in the do-it-yourself sector. In the trades sector or in industrial production painting, coatings are usually applied by means of compressed-air, airless, air-supported airless or electrostatic atomization. Particularly in workshop or industrial auto repair painting, either low-pressure paint sprayers or high-pressure paint sprayers are used; the other methods mentioned above are used only to a lesser degree. High-pressure spraying is the most common painting method. However, even if the quality of the surface meets the requirements of production painting in the automotive industry or for repair painting, this painting method has the greatest "overspray" and achieves a degree of application effectiveness of only about 30% to 50%.

While compressed air atomization takes place at pressures of 1.5 to 5 bar in high-pressure spraying, atomization of the paint material in low-pressure spraying takes place at pressures in the range of 0.7 to 1.0 bar. This low-pressure spraying method requires high air volumes, which are produced with fans, among other things. Since the atomizer pressure must be limited to 0.7 bar in certain states of the United States, and, at the same time, a degree of application effectiveness of at least 65% is required, paint spraying devices marketed under the designation HVLP ("High Volume Low Pressure") have recently been developed. Compared with conventional compressed-air atomization at 3.5 to 4 bar, low-pressure spraying has the advantage that paint mist ("overspray") is avoided to a large extent, and therefore a high material yield as well as a significantly improved degree of application effectiveness is achieved.

Conventional spray cans are used only to a very slight extent by professional users such as auto repair shops or in industrial production painting because of their low paint output rate and their very uneven paint application; instead, they are used primarily in the do-it-yourself sector.

OBJECTS AND SUMMARY OF THE INVENTION

It is therefore an object of the present invention to improve spray cans of the type stated initially in such a way that their paint output amount per unit time is significantly increased, so that a substantially greater layer thickness is achieved during the same working time, and the paint distribution on the work piece is substantially improved.

This objective is accomplished, according to the present invention, by a spray can in which the propellant generates a pressure of 4.5 to 6 bar, the output amount of the paint material is 15 g to 35 g per 10 seconds for uninterrupted output, and the paint is output in the form of broad-stream atomization.

A spray can in accordance with this solution is suitable for use in the professional sector because of its higher output rates, particularly for use of paints and paint preparation materials by professional car painters. As measurement results show, the degree of application effectiveness of the paint spray can according to the invention is comparable to or better than that of a modern HVLP paint spray gun. By applying the paint material in the form of broad-stream atomization, a working speed that comes close to the working speed of a spray gun is made possible. Furthermore, the distribution of the paint particles is so fine (because of the increased pressure in combination with the broad-stream atomization) that the distribution and the paint status yield comparable results as when a spray gun is used.

According to a preferred embodiment of the invention, the pressure in the spray can is 5.0 to 5.5 bar. The output amount of the paint material can then advantageously be 18 g to 28 g per 10 seconds in the case of uninterrupted output.

If pressure in the spray can is 5.2 bar, in a particularly advantageous embodiment of the invention, the paint output amount can be increased from usually approximately 10 g per 10 seconds for conventional spray cans, which have a pressure of 3.5 to 3.6 bar, to about 20 g to 24 g during the same time unit. This is accompanied, according to the invention, by an increased degree of application effectiveness as compared with a conventional spray gun. This is essentially due to the fact that no compressed air is used in the spray can according to the invention, while in spray guns, the material to be sprayed is subjected to a pneumatic pressure that produces a paint mist and furthermore causes air recoil in front of the work piece so that the approaching paint particles are partly thrown back. This effect is referred to as "overspray."

The desirable pressure increase compared to conventional spray cans can be achieved, according to the invention, by an additional proportion of propane added to the known propane/butane mixture, which generates a pressure of about 4.2 bar at 20° C., up to an amount at which the pressure in the spray can reaches the desired value. A pressure of about 5.2 bar can be achieved, according to the invention, if the propellant gas mixture consists of 72% known propane/butane mixture with a pressure of 4.2 bar at 20° C. and 28% propane with a pressure of 9.1 bar at 20° C.

By outputting the paint material in the form of broad-stream atomization, according to the invention, the increased paint output amount can be atomized more uniformly than by the conventional round spray nozzle, resulting in a homogeneous distribution of the paint particles, following the model of the ellipsoid spray shape produced by a spray gun. This makes it possible to achieve optimum distribution of the paint materials.

Other characteristics, advantages and applications of the invention are evident from the following description of examples of the invention in comparison with the known state of the art.

DETAILED DESCRIPTION

EXAMPLE 1

Known spray cans usually use a propane/butane mixture as the propellant gas, in which the ratio of propane to butane ranges from 50:50 to 65% propane and 35% butane. In this connection, the pressure of the propane/butane propellant gas mixture is always adjusted by the manufacturer to precisely the desired value of 4.2 bar. This, together with the paint material to be sprayed, results in a pressure of 3.5 to 3.6 bar in the spray can.

EXAMPLE 2

The propellant gas mixture according to the invention comprises 72% of the propane/butane mixture described in Example 1 with a pressure of 4.2 bar. 28% of the propellant gas mixture according to the invention is pure propane with a pressure of 9.1 bar. In total, this results in a spray can pressure of 5.2 bar.

This spray can pressure, which is extremely advantageous in combination with broad-stream atomization, must be individually adjusted for each paint material. Therefore the paint output also depends on the paint material to be sprayed to a significant degree. The more filler the paint material contains, i.e., the higher the solids content of the paint material to be sprayed, the higher the pressure required to achieve the desired spray amount.

By coordinating the level of the spray can pressure with the output amount of the paint material, a degree of application effectiveness is achieved that corresponds to that of a modern HVLP paint spray gun. Also, the distribution of the paint particles by the increased pressure and the broad-stream atomization is so fine that the paint distribution and the paint status yield comparable results as when using a spray gun, and this is achieved at comparable working speeds. Measurements of the layer thickness show that higher layer thicknesses can be achieved during the same time unit using the spray can according to the invention compared to spray guns.

The paint materials used were different materials such as base lacquers, clear lacquers, cover lacquers, as well as spray putty, corrosion protection agent, plastic adhesion agent, etc.

Significant advantages of the new spray technology of the spray can according to the invention, as compared with spray gun techniques, include significant material savings because there are no residual amounts, only a slight amount of spray mist, a high degree of application effectiveness, and no required consideration of pot life. Also, there will be lower costs due to lower energy costs (air consumption), as well as substantially lower disposal costs for paint materials. In addition, handling will be reduced, and there will be time savings since no setup time is required compared to spray gun technology, and no cleaning of spray guns is necessary. The can also has a lower weight, and ready-to-use paint mixtures can be used so that a mixing process is no longer necessary.

I claim:

1. A spray can for paint material, the spray can being pressurized with a propellant enabling the paint material to be sprayed when a valve in the can is opened, the propellant providing a pressure of 4.5 to 6 bar in the spray can, wherein the output flow rate of the paint material is 15 g to 35 g per 10 seconds for uninterrupted flow, and the paint material is output in a broad-stream atomization form, and wherein the propellant is a propellant gas comprising a propane/butane mixture having a pressure of about 4.2 bar at 20° C. with an additional amount of propane added to the propane/butane mixture sufficient to raise the pressure in the spray can to a desired value.

2. The spray can of claim 1, wherein the propellant gas mixture comprises 72% propane/butane mixture having a pressure of 4.2 bar at 20° C. and 28% propane having a pressure of 9.1 bar at 20° C. such that pressure in the spray can is approximately 5.2 bar.

3. A spray can for paint material, the spray can being pressurized with a propellant enabling the paint material to be sprayed when a valve in the can is opened, wherein the output flow rate of the paint material is 15 g to 35 g per 10 seconds for uninterrupted flow, and the paint material is output in a broad-stream atomization form, and wherein the propellant is a propellant gas mixture comprising 72% propane/butane mixture having a pressure of about 4.2 bar at 20° C. and 28% propane having a pressure of 9.1 bar at 20° C. such that pressure in the spray can is approximately 5.2 bar.

* * * * *